US011198962B2

(12) United States Patent
De La Lama Gomez

(10) Patent No.: US 11,198,962 B2
(45) Date of Patent: Dec. 14, 2021

(54) ENTANGLED FILAMENT MOLDED PRODUCT

(71) Applicant: Jose Geronimo De La Lama Gomez, Merida (MX)

(72) Inventor: Jose Geronimo De La Lama Gomez, Merida (MX)

( * ) Notice: Subject to any disclaimer, the term of this patent is extended or adjusted under 35 U.S.C. 154(b) by 1045 days.

(21) Appl. No.: 14/176,702

(22) Filed: Feb. 10, 2014

(65) Prior Publication Data

US 2014/0227517 A1 Aug. 14, 2014

Related U.S. Application Data

(60) Provisional application No. 61/762,866, filed on Feb. 9, 2013.

(51) Int. Cl.

| | |
|---|---|
| ***D04H 13/00*** | (2006.01) |
| ***D04H 1/64*** | (2012.01) |
| ***D04H 1/22*** | (2006.01) |
| ***D04H 1/488*** | (2012.01) |
| ***D06M 15/693*** | (2006.01) |
| ***D04H 1/425*** | (2012.01) |
| ***D04H 1/4258*** | (2012.01) |

(52) U.S. Cl.

CPC ..... *D04H 13/00* (2013.01); *D04H 1/22* (2013.01); *D04H 1/425* (2013.01); *D04H 1/4258* (2013.01); *D04H 1/488* (2013.01); *D04H 1/64* (2013.01); *D06M 15/693* (2013.01); *Y10T 428/2938* (2015.01)

(58) Field of Classification Search

CPC ..... D04H 13/00; D04H 1/64; D04H 1/22; D04H 1/425; D04H 1/4258; D04H 1/488; Y10T 428/2938; D06M 15/693

USPC ..... 442/58; 428/107

See application file for complete search history.

(56) References Cited

U.S. PATENT DOCUMENTS 1,566,165 A 12/1925 O'Brien
2,087,441 A * 7/1937 Metcalf ..... D01G 99/00 264/112
2,136,827 A 11/1938 Schur
(Continued)

FOREIGN PATENT DOCUMENTS

DE 31 20 875 A1 1/1982
DE 196 08 947 A1 10/1996
(Continued)

OTHER PUBLICATIONS

Dzikowicz, "Latexes", pp. 1-24, 2003.*
(Continued)

*Primary Examiner* — Elizabeth C Imani
(74) *Attorney, Agent, or Firm* — Tucker Ellis LLP

(57) ABSTRACT

A polymer filament molded product and a method of making a filament network that includes coating filaments with a latex polymer and shaping the filaments into a molded product; one in which a polymer is shaped and molded into a larger filament network. The molded products can be objects for apparel, home and garden, furnishings, health care, engineering, industrial and consumer goods. The molded filament mesh is "fractal" in nature because it is a filament interconnected network at the molecular scale and at the scale of the molded product. The natural tendency of the long molecule filaments to be an entangled structure is maintained.

20 Claims, 8 Drawing Sheets

(56) References Cited

U.S. PATENT DOCUMENTS

| | | | | | |
|---|---|---|---|---|---|
| 2,266,761 | A | * | 12/1941 | Jackson, Jr. | D04H 5/04 428/107 |
| 3,510,390 | A | | 5/1970 | Bjorksten et al. | |
| 4,338,369 | A | * | 7/1982 | Foenard | A01K 1/0157 119/169 |
| 4,673,616 | A | * | 6/1987 | Goodwin | D06M 23/14 264/319 |
| 4,698,257 | A | | 10/1987 | Goll | |
| 4,908,176 | A | | 3/1990 | Kato | |
| 7,815,995 | B2 | | 10/2010 | Clark et al. | |
| 2011/0272507 | A1 | | 11/2011 | Mendoff | |

FOREIGN PATENT DOCUMENTS

| | | | | | |
|---|---|---|---|---|---|
| EP | 0 237 665 | A1 | | 9/1987 | |
| JP | 51034283 | A | * | 3/1976 | |
| WO | WO-2006136456 | A1 | * | 12/2006 | A47C 31/006 |
| WO | 2014123404 | A2 | | 8/2014 | |

OTHER PUBLICATIONS

Machine Translation of DE 3120875, pp. 1-3.*
Young, R.A. "Vegetable Fibers" Encyclopedia of Polymer Science and Technology, Mar. 15, 2004.*
Properties, Processing of Natural Fibers, Dec. 19, 2012.*
PMM79709P.EPP—European Search Report.

* cited by examiner

ENTANGLED FILAMENT MOLDED PRODUCT

PRIORITY

This application claims the benefit of priority to U.S. Provisional Application Ser. No. 61/762,866, filed Feb. 9, 2013, and entitled "ENTANGLED FILAMENT MOLDED PRODUCT." The entirety of the aforementioned application is incorporated herein by reference.

TECHNICAL FIELD

The invention generally relates to a molded filament product. More particularly, the invention relates to a process of making a polymer filament product which includes coating filaments with a latex polymer and shaping the network of entangled and coated filaments into a molded product.

BACKGROUND OF THE INVENTION

It is known that a polymer is an entanglement of filament molecules and that these molecules are entangled by polymerization or cross linking. It is also known that a polymer can be shaped into various useful products. Typically, these products are shaped by first making smaller parts, like filaments or sheets, or by injection of the polymer into a mold.

Polymer-coated filament products can be prepared via extrusion of a solution containing a polymer component and a filament component. In one known process, a polymer coated cord is prepared by passing a fabric cord through a polymer coating die, to which an extruder for a polymer material is connected, and coating polymer on the surface thereof in a thin-filmy manner.

Additionally, polymer-coated filaments are used in nonwoven fabrics. These materials are broadly defined as sheet or web structures bonded together by entangling fibers or filaments mechanically, thermally or chemically. They are flat, porous sheets that are made directly from separate fibers or from molten plastic or plastic film. They are not made by weaving or knitting and do not require converting the fibers to yarn.

Nonwoven materials are typically manufactured by putting small fibers together in the form of a sheet or web (similar to paper on a paper machine), and then binding them either mechanically (as in the case of felt, by interlocking them with serrated needles such that the inter-fiber friction results in a stronger fabric), with an adhesive, or thermally (by applying binder (in the form of powder, paste, or polymer melt) and melting the binder onto the web by increasing temperature).

Additionally, objects made by injection of a polymer into a mold are well known in the arts. These molded polymers include foams and solid objects, such as tires and the like.

Notwithstanding the state of the art as described herein, there remains a need for entangled filament molded products like shoes and others.

A polymer is naturally an entanglement of filament molecules. An object of the invention is to control the entanglement of polymer filaments to mold any product with the correct density and shape. This is accomplished by first shaping a natural filament molecule mesh, which is a polymer, into a larger filament mesh through the addition of other fibers. These products are understood and treated as filament networks from the molecular scale to the larger final scale of the molded product. Just as nonwoven fabrics are not manufactured by weaving or knitting and do not require the conversion of fibers into a yarn, the filament modeled products do not require the filaments to be converted first into other objects. Instead, the filaments are taken through a process where the polymer molecule filament network is scaled up and modeled as a filament network by increasing the crosslink density at all scales.

As the natural filament mesh structure of the polymer is preserved and shaped into a form without ever changing its basic filament structure; the product remains at all scales in its most basic state. This makes for polymer structures that are very stable.

SUMMARY OF THE INVENTION

In general, one aspect of the invention is to provide a molded filament product. The molded filament product includes an interconnected network of filaments that includes a plurality of filaments entangled within the interconnected network, wherein the interconnected network is coated with an emulsion of polymer molecules in liquid medium (e.g., an aqueous medium that can be a portion of water) and dried to form a network of polymer filaments that can be shaped to form the molded product.

In another aspect of the invention, a method of preparing a molded product of a network of filaments is provided. The method includes the steps of providing a plurality of filaments, arranging the filaments to form an interconnected network of filaments, wherein the filaments are entangled within the network, coating the network of filaments with an emulsion of polymer molecules in a liquid medium (e.g., an aqueous medium that can be a portion of water) to form a coated network, drying the coated network to form a network of polymer filaments, and shaping the network of polymer filaments to form a molded product by increasing the crosslink density of the filaments.

DETAILED DESCRIPTION OF THE DRAWINGS

For a better understanding of the invention and to show how the same may be carried into effect, there will now be described by way of example only, specific embodiments, methods and processes according to the present invention with reference to the accompanying drawings in which.

DETAILED DESCRIPTION OF THE INVENTION

Figure 1:
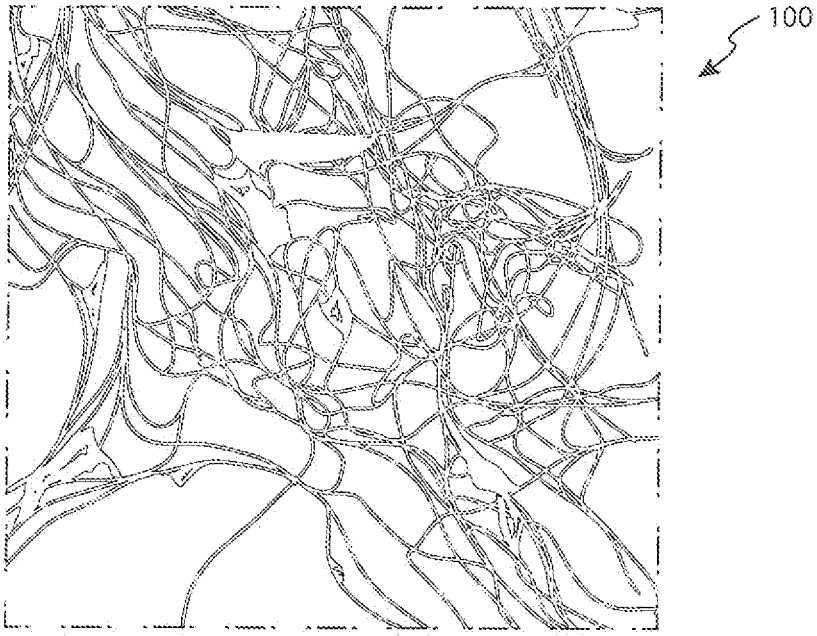
FIG. 1 illustrates a rubber coated filament network.
Figure 2:
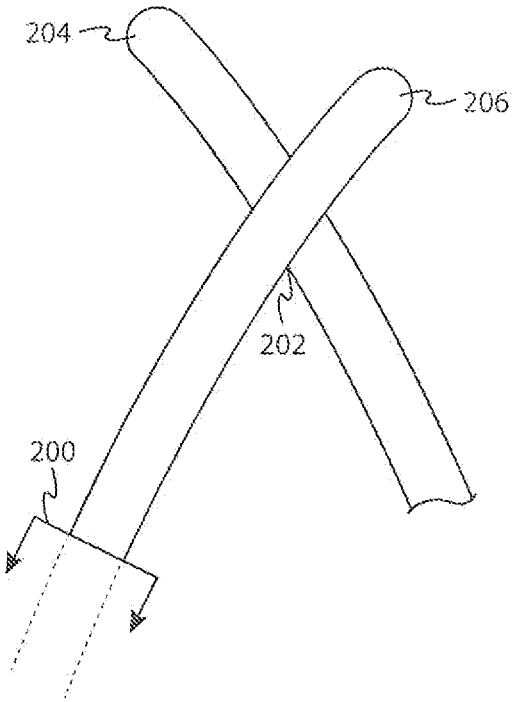
FIG. 2 illustrates two rubber coated filaments and the point between the filaments shows how only a small surface area of the rubber coat of one filament touches (and bonds) to the rubber coat of the intersecting filament, as both filaments are pressed together by a modeling force to create a crosslink.

In general, the invention relates to rubber filament molded structures. The terms "filament" and "fiber" may be used interchangeably herein. "Fiber" or "filament", as used herein, can be defined as an elongated arrangement of a group of cells capable of being shaped in a way that lends strength and/or support to an end product. For example, the terms "fiber" and "filament" may refer to a strand that is capable of being cross linked with other like strands in order to form a network of strands for use in various constructions. The term "network" as used herein can be defined as two or more fibers or filaments in contact. For example, FIG. 1 illustrates a filament network 100. The following references FIGS. 1-2. The rubber filament molecules are scaled up by other fibers by coating these fibers with rubber latex. The rubber coat 300 protects the fibers and allows for increasing the density of surface area contact 202 between the filaments 204 and 206, as seen in FIG. 2. The bonds reduce the length of the segments between the cross-links in a similar way as the chain-link molecules are set, for example, through a sulfur molecule. The rubber coat 300 makes cross-links possible at least in two different scales: at the scale of the molecular polymeric chains and at a higher scale of the rubberized fibers. Through the gradual shortening of the molecule chain segments and of the rubberized fibers, we can control the modeling process of the object.

The rubber-coated filaments 204 and 206 include a filament network 100. As an elastomer is made up of many joined coiled long chain molecules, a large group of coated fibers are entangled with each other to form a unified matrix or filament network 100 as seen in FIG. 2. The filament network 100 does not necessarily have a specific scale and could represent the polymer chain of rubber molecules or something much larger than what is shown in FIG. 1 and/or FIG. 2, illustrating the self-similar nature of the rubber-coated filament network 100. The rubber coat 300 on and within the fibers work to join them with each other in a similar way as the weak intra-molecular forces help keep the polymeric molecular chains together in a rubber matrix. Cross-links can also be seen in FIG. 2 and are cross linking that would show in a vulcanized elastomer after coating a network 100 of entangled fibers as disclosed in the subject innovation. The cross linking is further illustrated by showing the surface area contact 202 between the filaments 204 and 206.

Similar to rubber at a molecular level, rubber-coated filaments are set into a form through cross-links. This process makes the segments short and taut. As such, the network 100 becomes harder and more difficult to deform (both elastically and to mold) in a similar way as a thermosetting process makes an elastomer, like polyisoprene, once it is vulcanized.

Figure 3:
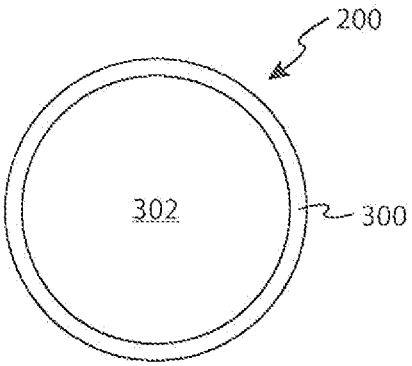
FIG. 3 illustrates a cross-section view of a rubber coated filament.

FIG. 2 includes a point of reference 200 of the filament 204 that is illustrated as a cross sectional view in FIG. 3. FIG. 3 illustrates a cross section view from the point of reference 200 of the filament 204. The filament 204 includes an inner layer 302 and an outer layer 300 which have different properties as discussed above.

The filaments can be entangled before they are coated. Once coated, it is possible to use the tacky rubber that can be partially vulcanized and, in this way, control the different areas of the network 100 for further entanglement until the right density and shape is achieved. The cross-linking can be substantially stopped by reducing tackiness through vulcanization or by the addition of a powder. The air between the filaments helps the rubber coat to dry and allows this material to "breathe".

In one embodiment of the invention, an interconnected network of filaments 100 is provided and includes a plurality of filaments entangled within the interconnected network 100. The interconnected network 100 is coated with an emulsion of polymer molecules in liquid medium (e.g., an aqueous medium that can be a portion of water) and dried to form a network of polymer filaments 100 that are manually shaped to form a molded product by increasing the crosslink density of the filaments.

The fibers that shape the polymer molecules into a larger scale interconnected network of filaments 100 include natural and synthetic fibers. Suitable examples of the natural fibers include, but are not limited to, sisal, cotton, silk, hemp, flax, alpaca, camel, llama, finn, wool, bamboo, corn husk, yute, linen, ocote and *Sansevieria trifasciata* natural fibers.

Suitable examples of the synthetic fibers include, but are not limited to, carbon, aramid, nylon, polyester, polymer, optic fibers and combinations thereof.

The emulsion of polymer molecules in an aqueous medium used to coat the interconnected network of fibers is latex rubber. The latex rubber may be natural or synthetic. Natural latex is a milky fluid found primarily in flowering plants. It is a complex emulsion with polyisoprene and water that coagulates on exposure to air. Synthetic latex is prepared by polymerizing a monomer, such as styrene, that has been emulsified with surfactants. In one embodiment, the latex rubber is either pre-vulcanized or includes a vulcanizing agent that can be vulcanized with heat. As utilized herein, pre-vulcanized is defined as the time before the vulcanization process takes place, i.e., the time before the process for converting rubber or polymers into more durable materials. In another embodiment, the latex rubber includes pigments, deodorants, anti-oxidants, viscosity-modifying agents, a fungicide, fire retardants and combinations thereof. Alternatively or additionally, the emulsion may include silicone alone or in combination with latex rubber.

The molded product can include, a pigment, a deodorant, zinc oxide, stearic acid, fire retardant a fungicide, and combinations thereof.

Figure 19:
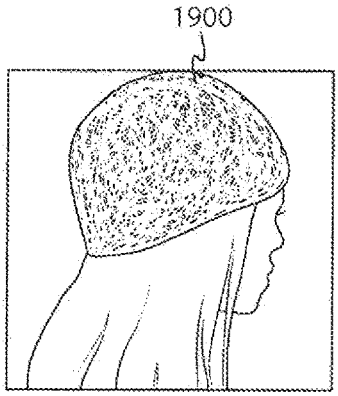
FIG. 19 illustrates a hat according to an embodiment of the invention.
Figure 20:
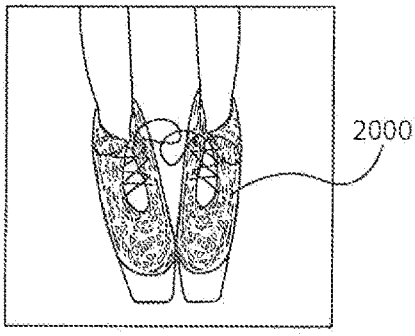
FIG. 20 illustrates a pair of ballerina shoes according to an embodiment of the invention.
Figure 21:
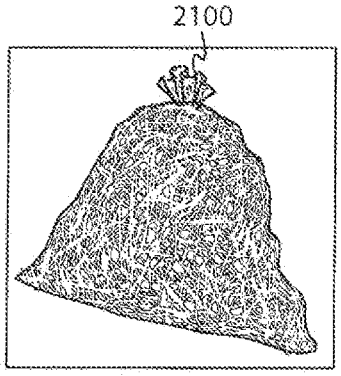
FIG. 21 illustrates a bag according to an embodiment of the invention.
Figure 22:
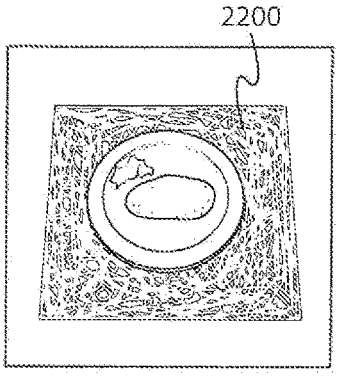
FIG. 22 illustrates a tablecloth according to an embodiment of the invention.
Figure 23:
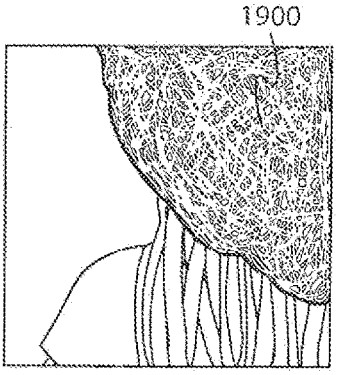
FIG. 23 illustrates a hat according to an embodiment of the invention.
Figure 24:
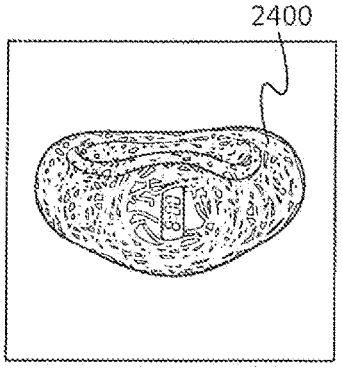
FIG. 24 illustrates a wristwatch band according to an embodiment of the invention.
Figure 25:
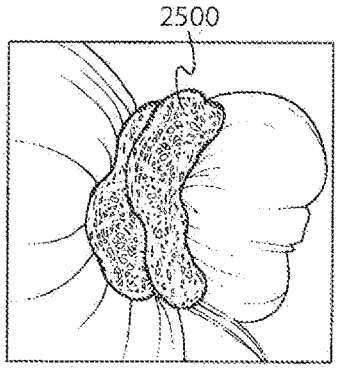
FIG. 25 illustrates a hair band according to an embodiment of the invention.
Figure 26:
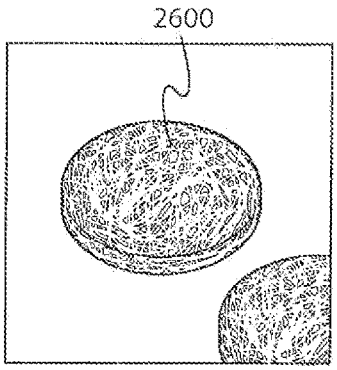
FIG. 26 illustrates a flying disc according to an embodiment of the invention.
Figure 27:
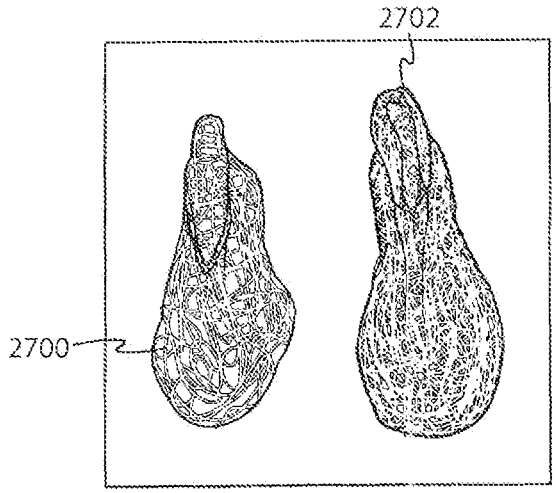
FIG. 27 illustrates an outer layer and inner layer of a shoe according to an embodiment of the invention.
Figure 28:
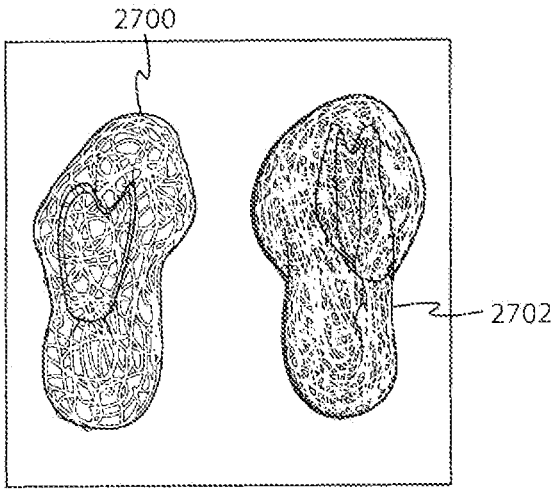
FIG. 28 illustrates a second outer layer and inner layer of a shoe according to an embodiment of the invention.
Figure 29:
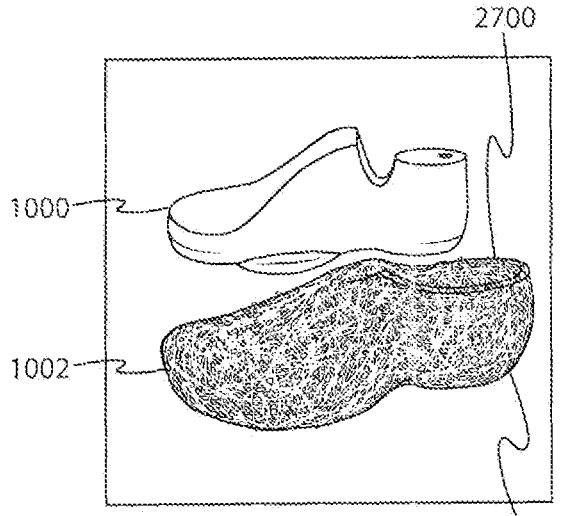
FIG. 29 illustrates a shoe last and a shoe according to an embodiment of the invention.
Figure 30:
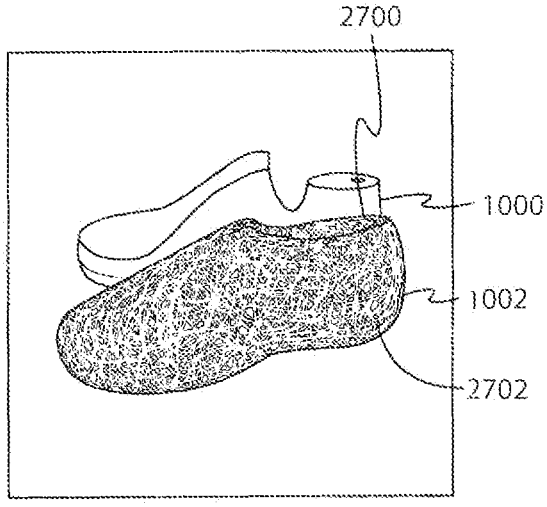
FIG. 30 illustrates a shoe last and a shoe according to another embodiment of the invention.
Figure 31:
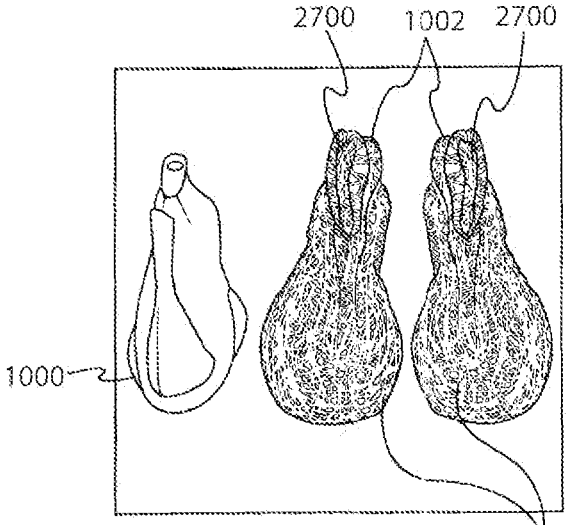
FIG. 31 illustrates a shoe last and the combined inner layers and outer layers of the shoes forming a pair of shoes according to an embodiment of the invention.
Figure 32:
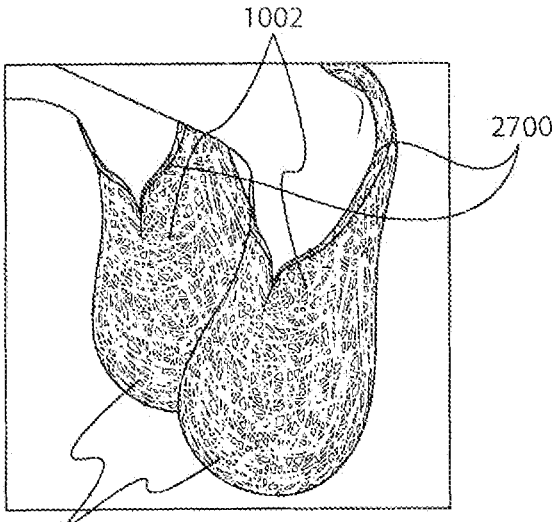
FIG. 32 illustrates a user wearing a pair of shoes according to an embodiment of the invention.

The molded product can be, but is not is limited to being, a shoe 1002 (e.g., discussed in FIG. 11), a hat 1900 (e.g., discussed in FIG. 19), a plant pot 1500 (e.g., discussed in FIG. 15), a lamp shade 1200 (e.g., discussed in FIG. 12), a basket, a house, an animal shelter, a boat, a bracelet, a chair, a cell phone cover, a hair band 2500 (e.g., discussed in FIG. 25), clothing, such as a jacket, jewelry, a belt, a wearable clothing item, a decorative item, an eyeglass frame 1304, and an item that can be created from a mold among others.

In another embodiment, a method of preparing a molded product of a network of polymer filaments 100 is provided. In general, the method includes providing a plurality of fibers and then arranging the fibers to form an interconnected network of fibers 100, wherein the fibers are entangled within the network 100. Depending on the type of fibers that are being used, these fibers are entangled so that they can hold this entanglement as they are coated with the latex rubber. But they are usually entangled as loosely as possible because the looser they are, the more flexible the initial mesh is to mold into any shape desired. For instance, the loose entanglement (besides affording a high amount of air circulation) also makes it easier to shape (or mold) into any desired form. This type of loose entanglement also provides the benefit of allowing air to circulate through the wet latex coat and evaporate the water in this latex coat more easily. In other words, a looseness of the entanglement is based on an amount of air circulation through a wet latex coat and the evaporation thereof. Thus, a loose entanglement affords a high amount of circulation and a non-loose entanglement affords a low amount of circulation. The entanglement looseness is done in different ways and sizes depending on the final object desired and on the type of fibers used to shape the latex rubber into a mesh. For instance, the longer the fibers, the easier it is to entangle them in a loose manner which can allow for increased air circulation to when coated with the latex rubber.

Figure 4:
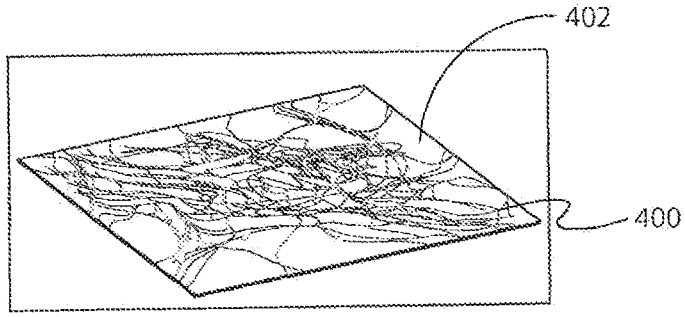
FIG. 4 illustrates a method of preparing a molded product of a network of polymer filaments in accordance with the subject innovation.
Figure 5:
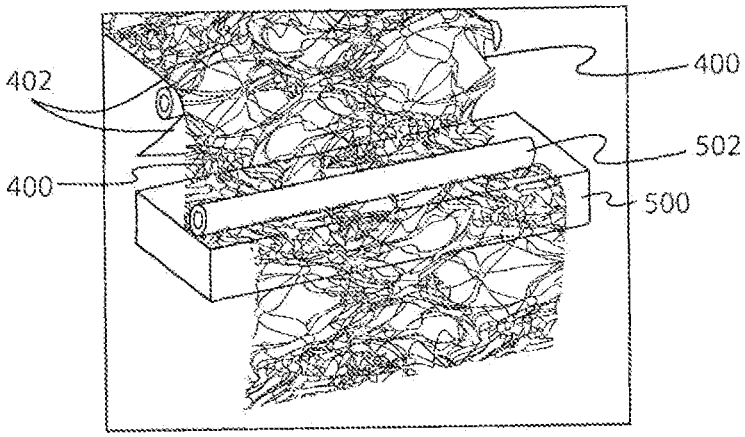
FIG. 5 illustrates a method of preparing a molded product of a network of polymer filaments in accordance with the subject innovation.
Figure 6:
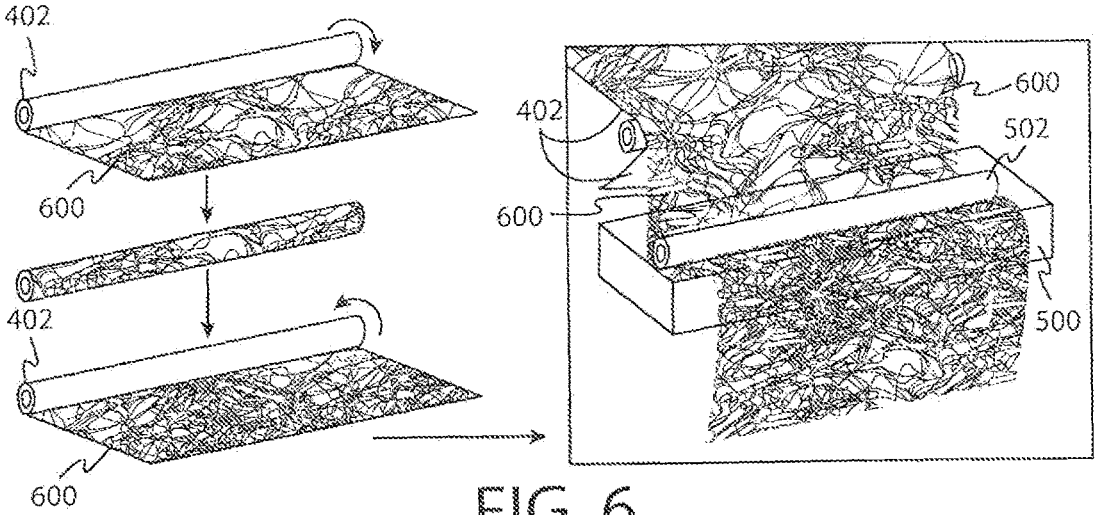
FIG. 6 illustrates a method of preparing a molded product of a network of polymer filaments in accordance with the subject innovation.
Figure 7:
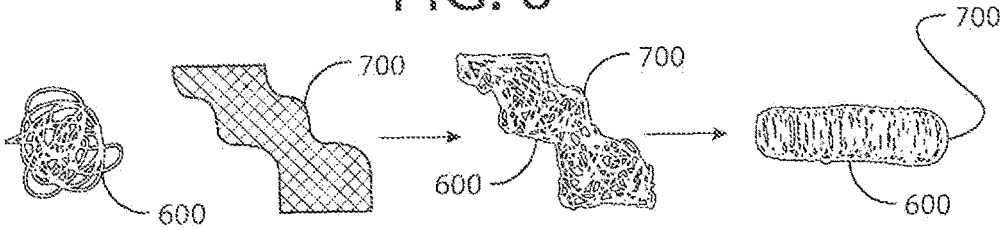
FIG. 7 illustrates a method of preparing a molded product of a network of polymer filaments in accordance with the subject innovation.

FIGS. 4-7 illustrate a method of creating a molded network of fibers 400 that have a water and latex coating of which water is evaporated therefrom. FIG. 4 illustrates loosely arranged fibers. FIG. 5 illustrates coating sisal fibers. FIG. 6 illustrates coating carbon fibers. FIG. 7 illustrates drying and the beginning of a shaping process. By way of example and not limitation, these fibers may be either sisal fibers or carbon fibers in various embodiments. FIG. 4 illustrates a flattened entanglement of sisal fibers 400 (discussed in more detail below). FIGS. 5 and 6 illustrate manners in which to coat the entangled fibers with a water and latex coating mixture (discussed in more detail below), wherein FIG. 5 illustrates a loose configuration of the entangled fibers and FIG. 6 illustrates a dense configuration of the entangled fibers. For instance, density can be increased by a pre-rolling of the fibers on foil and unrolling such rolled fiber before coating in latex (discussed in more detail below). Further, it is to be appreciated that the foil 402 in FIGS. 4-6 does not enter the container 500 where the coating of the fibers occurs. FIG. 7 illustrates a coated network of sisal fibers 400 that is in the process of drying (e.g., water from the water and latex mixture being evaporated) with layers of the network of sisal fibers 400 being separated by a fish net or other suitable air permeable member 700 (discussed in more detail below).

By way of example and not limitation, as can be seen in FIG. 4, an entanglement process is illustrated. A plastic foil 402 having dimensions of 50×1.4 meters was laid on the ground. Sisal fibers 400 measuring in average 90 cm in length and having a diameter of 25 μm were laid on the foil 402 with an average density of 350 fibers/$m^2$, and both the foil 402 and the fibers 400 were rolled flat. This process can be done by hand without need of any external power. For instance, a rolling pin can be used to roll the sisal fibers 400 and foil 402. Additionally, carbon fibers can be laid on the foil 402, wherein about 12,000 fibers were laid on the plastic foil 402 having dimensions of about 50 meters in length and about 1.4 meters wide.

The method also includes coating the network of fibers 400 with latex rubber to form a coated network (e.g., also referred to as a fiber mesh). In this step, the network of fibers can be coated, by any one of dipping, spraying, brushing, or rolling (e.g., rolling a foil 402 with flattened sisal fibers 400 onto the latex rubber or vice versa). In an embodiment, the foil 402 is not passed into the container 500 that contains the latex. For example, a conveyer-belt system can be used in with the foil 402 is the belt that delivers the fibers 400 to the container 500 for the dipping process. In another embodiment, the foil 402 can be passed into the container 500 with the fibers 400 for coating. By way of example and not limitation, coating the fibers 400 in the latex rubber is carried out by a dipping process in the latex rubber in any suitable container 500 (e.g., tank, bucket, jar, and the like). In an example, the fibers 400 can be introduced and removed from the tank 500, bucket or jar by a series of rollers 502, wherein a first roller 502 can transport the flattened sisal fibers 400 into the container 500 of the latex rubber and a second roller 502 can remove the flattened sisal fibers 400 from the container 500. It is to be appreciated that the first roller 502 or the second roller 502 can be manually controlled, automatically controlled, or a combination thereof (e.g., first roller 502 manual, second roller 502 automatic, etc.). For instance, a second roller 502 can be manually controlled of which the first roller 502 is not controlled and used as a guide. In another example, the fibers 400 can be introduced and removed from the containers 500 in rolls that include the foil 402 and flattened sisal fibers 400, wherein the rolls are submerged to ensure coating on all of the sisal fibers 400 for coverage. The coating of the fibers 400 in the latex rubber can be also carried out by spraying or by any other method known in the art.

In a particular embodiment, a plastic foil can be separated from the loose fiber mesh as the mesh is fed through rollers into and out of the container that contains the latex rubber.

The plastic foil can be rolled with the fibers before it is fed to the tank and it is rolled on to itself when it is separated from the fiber mesh (so that it can be used again). In general, the plastic foil can be used (e.g., a manual procedure) but an automated procedure can be utilized as well (e.g., conveyor system, conveyer belt, etc.).

In one embodiment, the fibers 400 are immersed in latex rubber. The immersion can take place in a container 500 or tank that contains the latex rubber. The latex rubber can be diluted in water so that the rubber coat in the fibers 400 is thinner. For instance, the ratio of latex rubber to water can be 1 to 1. By way of example and not limitation, the percentage of water can be approximately in a range of 35% to 75%. By way of example and not limitation, the percentage of latex can be approximately in a range of 30% to 70%. It is to be appreciated that the ratio of water to latex can be selected with sound engineering judgment and departure from the above ranges is intended to be included within the scope of the subject innovation. The fibers 400 are guided via rollers 502 into the tank 500 and then rolled so that the fibers 400 are completely immersed and wetted with the latex rubber. The rollers 502 can then guide the wet fibers 400 out of the latex and off the tank 500 with the help of a large spatula that separates the fibers 400 from the roller 502 and leaves them to hang out of the tank 500 so that the water in the latex can begin to evaporate (once the network of fibers 400 has been completely soaked in latex rubber) to create fiber mesh. The rollers 502 and tank 500 also help take off excess latex rubber from the fiber mesh before it begins to dry. An air permeable member 700 (e.g., netting, fishing-net, cloth, panty hose, drying rack, etc.) can be placed between the layers of coated filaments in a dry or semi dry state to expedite drying and allowing the placement of one fiber mesh on top of another fiber mesh.

The degree of impregnation of the latex rubber onto the fibers depends upon the type of fibers used and on the amount of water in the latex. However, this concern is minimal since the fibers are more used to shape the rubber (i.e. first into a larger filament mesh and then into a desired shape). The type of fiber is chosen more for its physical characteristics than for the strength of bonding to the rubber; it is because of this, that many types of fibers can be used with good results and for many purposes. Long fibers are preferred in this invention; they are preferred because they help hold the structure of the mesh as a loose entanglement, as it is being molded and throughout the use of the product as tensile elements. They also help preserve (at a larger scale) the same long polymeric structure of the rubber molecules at all scales. This natural state of rubber is never changed and makes for objects that will degrade less as they tend to degrade into their natural state.

For example, as can be seen in FIG. 5, previously rolled sisal fibers 400 are directed through a tank 500 filled with latex rubber so that they are completely immersed and wetted with latex rubber. Since the sisal fibers 400 are not continuous, in contrast to carbon fibers or silk fibers, the latex rubber was not diluted with water more than to the amount of 45% water or 55% rubber ratio. The raw natural latex rubber was mixed with an accelerant and an antioxidant so that it could be vulcanized with heat after the step of forming the molded product. The rollers 502 of the tank 500 guided the fibers 400 to the tank 500, under the latex rubber and out of the tank 500. In an embodiment, the foil 402 is not passed into the container 500 that contains the latex. For example, a conveyer-belt system can be used in with the foil 402 is the belt that delivers the fibers 400 to the container 500 for the dipping process. In another embodiment, the foil 402 can be passed into the container 500 with the fibers 400 for coating. In an embodiment, a rolling and unrolling of fibers 400 and foil 402 can be used to maintain the desired density. As the rubber-coated fibers come out of the tank 500, they hang due to gravity from the tank 500 and evaporation of water from the latex rubber begins.

In another example, as can be seen in FIG. 6, previously rolled and entangled carbon fibers 600 5 μm in diameter and of the length 50 meters or more were immersed and wetted in latex rubber in the tank 500. A higher density of the fibers 600 is achieved in comparison to the fibers 400 in FIG. 5 based on a rolling and unrolling of the fibers 600. For instance, a rolling of an amount of fibers 600 on a foil can be used to maintain a desired density of fibers. Upon achieving a desired density, the fibers 600 and the foil can be unrolled to move to the coating process. The coating process can allow the fibers 600 to be coated by latex contained in the container 500, wherein the foil is not passed into the container 500. In another embodiment, the foil can be passed into the container 500. The latex rubber was diluted with water at a about a 60% water or 40% rubber ratio. This is possible because the entangled coated fibers can be left hanging to dry without the risk of untangling and falling. The latex rubber was mixed with accelerants and antioxidants so that it could be vulcanized with heat at a later time. The rolls 502 of the tank 500 guided the fibers 600 easily through the tank 500, under the latex, and out of the tank 500. The fibers 600 can easily be guided through since the length of each fiber is of the entire 50 meters of the roll. As the wet fibers 600 come out of the tank 500, they hang through gravity from the tank 500 and the evaporation of the water in the latex begins.

The next step in the process includes drying the coated network to form a network of polymer filaments 100. After the loosely entangled network of fibers is coated with latex rubber thereby forming a fiber mesh, air can easily circulate through the mesh and evaporates the water in the latex. In another embodiment, the coated mesh may be hung and left to dry in the open air until the water evaporates depending on the size and shape of the mesh. Still yet, the coated mesh can be guided through a series of rollers 502 if it is flat and long. Furthermore, the coated mesh may be configured in a roll with an air permeable member 700 (e.g., netting, fishing-net, cloth, panty hose, drying rack, etc.) in between separate layers of mesh. The air permeable member 700 can be placed in the roll just after it hangs from the dipping tank 500 for about ±2 meters as it is being fed out of the tank 500. The air permeable member 700 can be used when the mesh is so tacky such that it will stick to each other if it is taken through the rollers 502. It is plausible to use the air permeable member 700 with synthetic fibers or other fibers that are very thin and multiple, such as carbon or silk fibers, in comparison to other larger fibers, such as sisal. The air permeable member 700 still allows air to go through the mesh and evaporate the rest of the water in the latex coat. In other instances, the uncoated fibers are loosely entangled around the mold that will help shape the object. Additionally, a second coat of latex rubber can be applied to the mesh when it has already been partially molded. Moreover, drying can still take place because the mesh is still permeable by air.

In an embodiment, the fish net can be used to roll the wet or semi vulcanized rubberized mesh (but the mesh can be rolled on to itself also if it is not too tacky).

For example, rubber-coated sisal fibers' 400 entanglement was 80 cm wide and 45 meters long. The rubber-coated fibers were guided through a series of rollers 502 to dry. Special care should be taken so that the entangled coated fibers are not compacted and tightened. The rubber-coated fibers were left to dry over night before they were rolled for further use.

In another example, as can be seen in FIG. 7, rubber-coated carbon filaments 600 were hung for about 2 meters. The water from latex rubber started to evaporate and the filament mesh did not stick to one another. Then the rubber-coated filaments 600 were rolled. An air permeable member 700 (e.g., netting, fishing-net, cloth, panty hose, drying rack, etc.) can separate single layers of coated filaments in the roll and allowed air to circulate between rubber-coated filaments and water from the latex rubber finished to evaporate overnight. The rolling of the mesh was made as loose as possible which allowed air circulation. The size of the mesh was 95 cm wide and 48 meters long. The roll was then left overnight to dry. The roll of the rubber-coated and dried filaments can be cut with scissors into smaller mesh parts so that the right amount of material is molded. The rubber-coated and dried filament mesh is usually not very dense, it can also be bent and folded on to itself. The final objects can often be molded with many layers without making the objects much heavier. They can also be entangled with more or less force to control how dense and stiff the final objects are.

Any polymer can be used to achieve other desired qualities of the finished product. A polymer that hardens in the final stage of the process can be used if a hard structure is desired.

The next step in the process is shaping the loose network of polymer filaments 100 to form a molded product. Once the water evaporates from the latex, the coated mesh is tacky and can stick onto itself and other coated meshes. Depending upon how the rubber filament mesh was made and on the desired shape of the molded product, the modeling process can vary in time and technique used. In one embodiment, the coated mesh is first rolled and stored so that it can be used later as desired. The roll can be made with a substrate, such as a plastic sheet, a plastic mesh, or an air permeable member 700, placed in between separate layers of the mesh as it is rolled on top of itself. It can also be loosely rolled on to itself if it is not too tacky. The rubber usually becomes less tacky as time passes. This has to be considered as all the variables of covering material and storage time can be used for the right purpose. The tacky rubber-coated mesh is further entangled, with the help of its tackiness, to a desired shape, density, size, color, smell and any other desired characteristic. This is usually done with a combination of a mold, manually by a user (e.g., a hand, a foot, a head, etc.), powders, heat, and even tools that help cut, twist, tighten, stretch and compress the mesh on to itself. All the variables since the beginning of the process make this invention versatile to create any object desired. When the rubber coated filaments are forced to each other to be modeled to a specific shape; the force that is applied is focused in the points that are needed (in the cross links as is shown in FIG. 2).

In a further embodiment of the process, additional filaments can be added before the molding step continues. The filaments are entangled, depending on a desired level of networking of the product. The entanglement can be made by hand, laying one filament over and/or next to another. Alternatively, filaments can be put on the first face of a plastic foil 402, having a first face and a second face, which is rolled and the filaments are thereby entangled. Filaments can then stay in the rolls to be further processed. As additional filaments are added, the steps of coating, drying, and shaping can be carried out. These steps can be repeated until a desired structure of the molded product is reached.

In order to make the filaments distinguishable in the final molded product and shaping of the filaments easier, tackiness of the filaments can be decreased by vulcanization of the latex rubber. In one embodiment, at least a part of the latex rubber is pre-vulcanized in order to modify tackiness of the filaments, whereby the amount of pre-vulcanized latex rubber can differ when steps of preparing the molded product are repeated. Also the degree of pre-vulcanization can differ when the steps of preparing the molded product are repeated. In another embodiment, vulcanization by heat can be implemented. For instance, the vulcanization by heat can increase a crosslink density at a molecular scale. By way of example and not limitation, the vulcanization by heat can be provided by any suitable heat source such as an oven, a fire, a heat source, or a heat gun, hot water, water vapor, stove, microwave, among others. Commercially available pre-vulcanized latex rubber can be used.

Alternatively or in addition to this, an accelerant, comprising sulfur, is added to the latex rubber prior to coating the network of filaments 100. The amount of the accelerant can differ when the steps of preparing the molded product are repeated. To facilitate the curing of the latex rubber, the rubber-coated filaments are heated after the molded or partially molded product is formed. The time of heating can be varied when the steps of preparing the molded product are repeated. Any commercially available sulfur-containing accelerators can be used.

Alternatively or in addition to this, a powder is used in the preparation of the molded product. In one embodiment, the powder is added to the liquid latex rubber prior to coating the network of filaments 100. The amount of powder added may vary depending upon the desired characteristics of the latex rubber when carrying out the steps of preparing the molded product. In general, the powder should be diluted in water with the correct PH so that it is easier to mix with the latex rubber. The addition of the powder to the latex rubber can promote desired changes including enhanced vulcanization properties, a change in color, and modification of the viscosity. In another embodiment, the powder can be added to dried network of polymer-coated filaments in a semi-crosslinked or crosslinked state. The powder can be added to the rubber-coated filaments prior to commencing vulcanization when the accelerant is used. The addition of the powder provides the benefits of modifying the tackiness of the rubber-coated filaments, as well as other characteristics like the color, smell or humidity of the molded product. Various powders can be used including corn starch, wheat starch, calcium carbonate, ground wood, ground coal, ash, ground leaves, ground seeds, ground plants, a pigment, polyacrylamide and combinations thereof. When ground plants are used as tackiness modifiers, they provide different and unique aromas and colors to the molded product. In an embodiment, at least one of the natural fibers or the rubber can be colored with natural colors. For example, the natural colors can be extracted by heating bark of trees in a portion of liquid (e.g., water, among others) and having this portion of liquid added to the latex or tinting the fibers in the portion of liquid.

For example, a first network 100 of polymer coated filaments created can be used with at least one additional network 100 of polymer coated filaments to form a molded product. By way of example and not limitation, a pair of shoes 1002 can be created that include one or more networks 100 of polymer coated filaments that include various properties afforded from the creation process described above (e.g., using different properties during the process such as, but not limited to, heating, dry time, looseness, type of fiber, vulcanized, use of sulfur, coating amount, water/latex ratio, powder use, among others).

The following paragraphs will describe various uses for the network 100. These are solely exemplary embodiments and are not meant to be limiting in either the variety of uses for the network 100 or the applications of the network 100.

Figure 8:
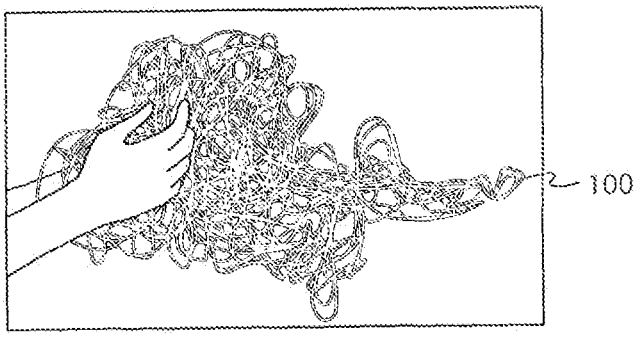
FIG. 8 illustrates a pair of hands beginning to work with a rubber coated filament network.
Figure 9:
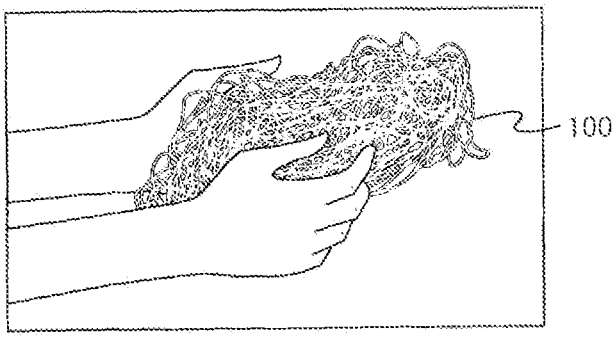
FIG. 9 illustrates a pair of hands beginning to mold a pair of shoes according to an embodiment of the invention.
Figure 10:
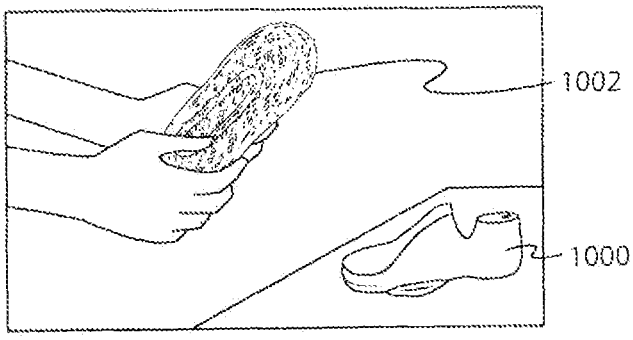
FIG. 10 illustrates a pair of hands further molding a pair of shoes with the assistance of a shoe last.
Figure 11:
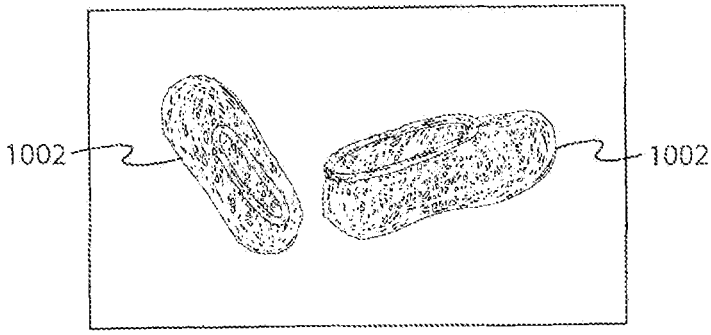
FIG. 11 illustrates a pair of shoes molded from a rubber coated filament network.

In one embodiment, a pair of shoes 1002, as seen in FIG. 11, are produced according to the method of preparing a molded product of a network 100 of polymer filaments as described herein and shown in FIGS. 8-11. FIGS. 8-10 illustrate a shaping process. FIG. 8 illustrates the network 100. FIG. 9 illustrates a user molding the network 100 onto and/or around a shoe last (e.g., also referred to as a shoe mold and illustrated in FIG. 10). FIG. 10 illustrates a shoe (e.g., one of the pair of shoes 1002) removed from being molded to the shoe last 1000. FIG. 11 illustrates a pair of shoes 1002 made with the network 100. It is to be appreciated that any shape, size, or material can be used as a mold to which the network 100 can be manipulated with.

The shoes 1002 were molded by hand with the assistance of left and right shoe lasts 1000 (e.g., shoe molds). The exerted modeling forces give shape to the filament matrix by increasing the crosslink density of the rubber-coated filaments. It should be noted that there still exist spaces between the filaments where further coats can be applied. This spaces assist with ventilating the foot and solves some of the problems that rubber shoes have had in the past. The rubber coating protects the filaments from water and other elements.

For example, tacky uncured rubber-coated and dried sisal filaments were loosely rolled on to themselves. A 1.2 meter× 1.2 meter approximate areas of the loose mesh was cut from the roll of rubber-coated and dried sisal filaments. The mesh was molded into a shoe 1002 using a shoe last 1000, it was entangled tightly around the last, cross linking the filaments by the tacky uncured rubber. Next, another amount of material of the same approximate size was again cut and added, this time it was wrapped more loosely around the previously molded filaments. The last was removed from this semi molded polymer molecule mesh and then vulcanized in heat to make more permanent the shape of the inside tight molecule filaments and of the loose filaments that where added later. The time spent in the oven was about 30 minutes at 95 degrees C. The entangled vulcanized filaments where put back in the shoe last and another of the same amount of uncured mesh "a 1.2 meter×1.2 meter areas" was cut from the roll and tightly wrapped around the first entangled and vulcanized filaments and the last. Still another amount of mesh was added and molded by hand until the desired shape and density was reached. The inside loose mesh (that was vulcanized first) and the tighter outside mesh help maintain a tension between the inside and outside filaments and, at the same time, a desired "soft-loose" feel to the shoe 1002. The same steps were carried out with the left and right shoe 1002. Both shoes 1002 were compared, each of them molded with hands and without the shoe lasts 1000, so that they both match in shape and density. An extra portion of un-cured latex rubber was added to the sole area with a brush. This aids in holding the mesh layers together and also adds extra protection to the filaments of the sole area. Huyacan wood powder was added to the sole part, Balche and Chacah plant leaf powder to the inside of the shoes as each have a pleasant smell, and corn starch powder was added to the outside-top part of the shoes 1002. Both shoes 1002 were heated once again in the electric oven for 30 minutes at 90 degrees C. so that the rubber molecule filament matrix is vulcanized. The shoes weighed 151.5 grams (left shoe) and 143.5 grams (right shoe). However, it is to be appreciated that each shoe 1002 can be created to have the same weight or different weights if so desired. The shoes 1002 are comfortable and light when compared with standard leather shoes 1002. With natural rubber as the "outer wall" of the filaments and sisal as the "core" of the filaments, an all-natural molded product was achieved. Natural rubber, in combination with the wide variety of natural fibers, gives possibilities for apparel and consumer products that are very friendly to the body and at the same time, resistant to the elements. As rubber is only a small % of the molded product (the rest being the natural fiber or the air in between the filament mesh), the weight and cost of the product is reduced. This can make an all-natural product that can compete with synthetic polymer-injection molded products. The molded mesh becomes an interconnected network of polymer "tubes" in air. These shoes 1002 are biodegradable.

Figure 12:
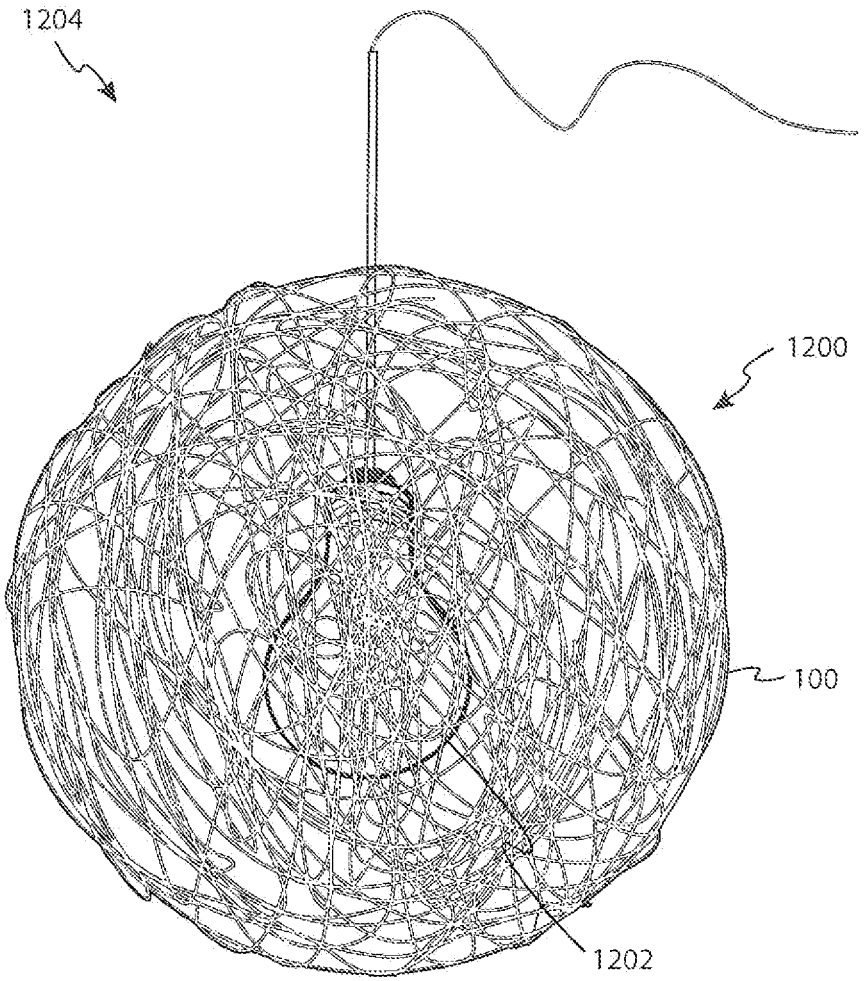
FIG. 12 illustrates a lamp shade according to an embodiment of the invention.

In yet another embodiment, a lamp 1204 including a lamp shade 1200, as seen in FIG. 12, is produced according to the method of preparing a molded product of a network 100 of polymer filaments as described herein. The lamp shade 1200 was molded by hand out of a balloon that served as a mold. The translucent qualities of natural rubber and the space left by the filament network 100 filter the light from the light bulb 1202, and also, the light color of the fiber, help to reflect it. It is to be appreciated that any shape, size, or material can be used as a mold to which the network 100 can be manipulated with.

Figure 13:
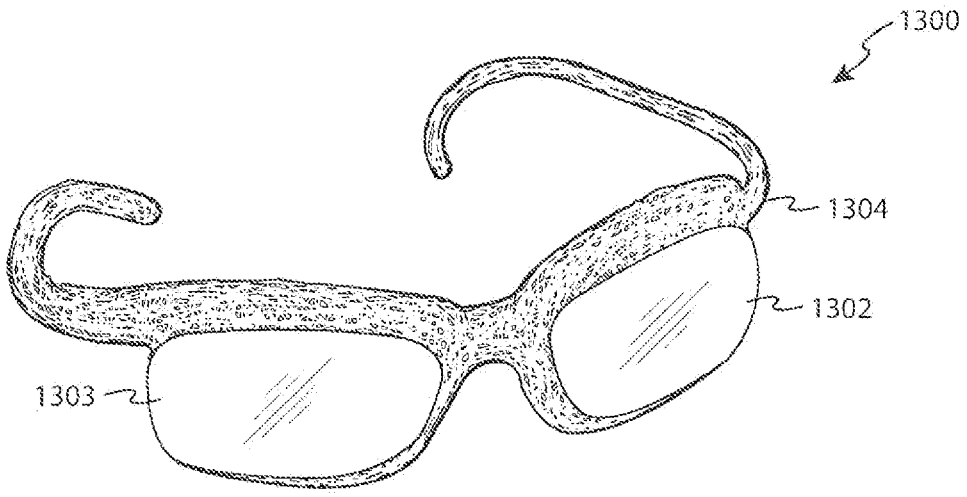
FIG. 13 illustrates glasses frames according to an embodiment of the invention.
Figure 14:
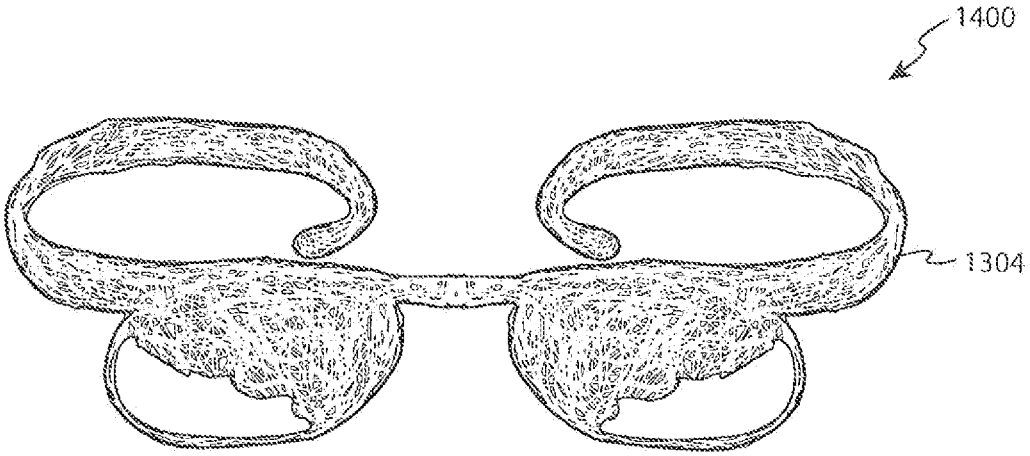
FIG. 14 illustrates glasses frames according to another embodiment of the invention.

In still yet another embodiment, a folding pair of glass frames 1304, as seen in FIGS. 13-14, is produced according to the method of preparing a molded product of a network 100 of polymer filaments as described herein. FIG. 13 is a perspective view of a pair of glasses 1300 created through use of the filament network 100 for the glass frames 1304. FIG. 14 is a view 1306 that illustrates the folding pair of glass frames 1304 during creation or molding before a location for lenses (e.g., first lens 1303, second lens 1302, collectively referred to as lenses) are made. In this embodiment, raw unvulcanized latex rubber and accelerant was used with carbon fibers in preparing a loose roll of polymer filament mesh for the glass frames 1304. The carbon fiber has the benefits of being a high tensile strength material, yet lightweight. It is also the fiber that has shaped the polymer molecules into the thinnest, longest, tackiest and numerous entanglement of filaments so far. The resulting polymer molecule mesh, is very useful to mold small and detailed objects and mostly approaches the base scale of the chain link molecule structure of the rubber.

For example, in preparing the glass frames 1304, a loose mesh of rubber-coated and dried carbon filaments material was put in each glass lens 1302 and 1303 that will later bond the "string mesh" to the rest of frame entanglement. A "string mesh" was made that went in the groove of each lens 1302 and 1303. A small area was cut from the roll of rubber-coated and dried carbon filaments. The modeling material was put around each lens 1302 and 1303 in two layers and then rolled to the groove. As it was rolled, it tightened as it was formed into exact shape of the rim of each lens 1302 and 1303 and then fell inside the groove. A longer area was cut from the roll of rubber-coated and dried carbon filaments. It was placed symmetrically off each glass lens 1302 and 1303. It was then shaped into glasses arms. Similarly, the middle part of glass frame 1304 was shaped. As this polymer mesh was very tacky, all the areas of the frame 1304 are united into one continuous entanglement of filament molecules. A carbon powder was added before vulcanization, and then the product was vulcanized for 30 minutes at 90° C. The excess of carbon powder was washed off with water. The glass frames 1304 produced in this manner are light and can be folded and return to their original shape when let loose.

Figure 15:
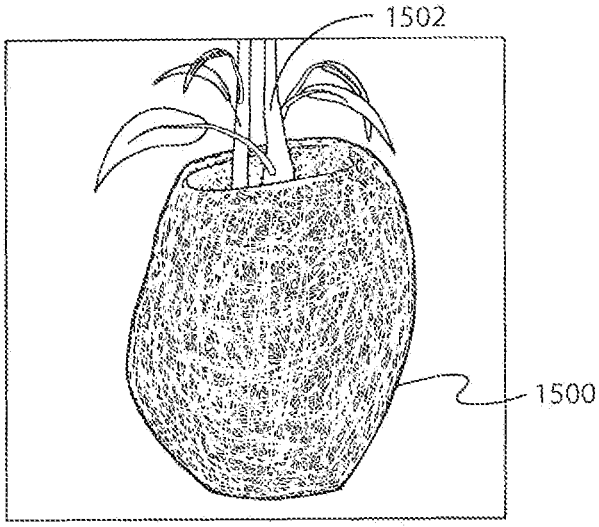
FIG. 15 illustrates a plant pot according to an embodiment of the invention.
Figure 16:
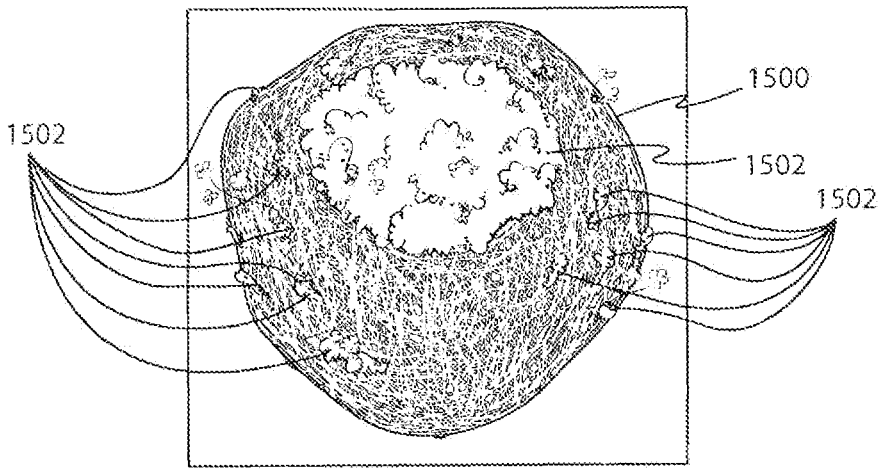
FIG. 16 illustrates a plant pot with the plant growing out of the top and sides of the plant pot according to another embodiment of the invention.
Figure 17:
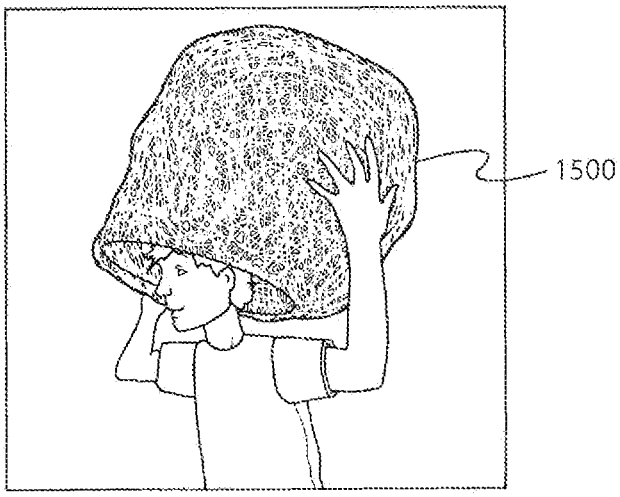
FIG. 17 illustrates a person holding a plant pot.
Figure 18:
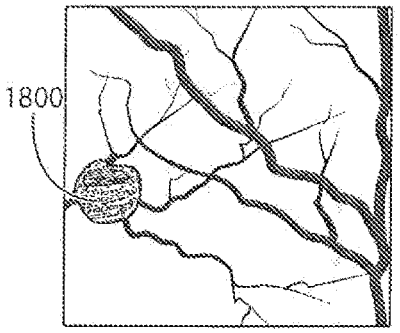
FIG. 18 illustrates a nest according to an embodiment of the invention.

In another embodiment, a plant pot 1500, as seen in FIGS. 15-17, is produced according to the method of preparing a molded product of a network 100 of polymer filaments as described herein. In this embodiment, a mesh of rubber-coated filaments is easily molded into the desired shape for housing a plant 1502. It is envisioned that an unlimited number of different sizes plant pots 1500 can be produced in order to accommodate various types of plants 1502. As seen in FIG. 16, a highly water-absorbent powder like polyacrylamide can be applied to the pot 1500 and foment root and plant growth through the filament mesh (as the plant 1502 looks for sun light or as the root looks for humidity and nutrients). Further, FIG. 17 shows that the pot 1500 may be of various sizes, even big enough for a person to hold it so that the head of the person could actually fit inside the pot 1500.

In yet other embodiments, as seen in FIGS. 18-26, various products are produced according to the method of preparing a molded product of a network 100 of polymer filaments as described herein. In these embodiments: a humming bird's nest 1800 is made with rubber-coated fibers of wild cotton; a hat 1900 is made with rubber-coated silk fibers and gold pigment powder; a pair of ballerina shoes 2000, a bag 2100 to collect dry leaves, a tablecloth 2200 and a hat 1900 are made with rubber-coated sisal fibers; a wristwatch band 2400 is made with rubber-coated silk fibers; a hair band 2500 is made with entangled rubber-coated silk and carbon fibers; a flying disc 2600 is made with rubber-coated carbon fibers. It is envisioned that an unlimited number of different sizes and shapes can be produced in order to accommodate various types of uses and that the above embodiments are solely for example and not to be seen limiting on the subject innovation.

In another embodiment, two pairs of shoes 1002, as seen in FIG. 27-32, are produced by combining rubber coated fibers of silk 2700 first, then *Sansevieria trifasciata* and then sisal rubber coated fibers 2702 in the outside and sole of the shoe 1002. In other words, a first network of fibers and a second network of fibers can be utilized together. In this example, a first network is used for an interior 2700 and a second network is used for the exterior 2702. Pre-vulcanized rubber coated sisal fibers where used for the first part of the sole.

The shape of the shoe-lasts 1000 were first changed knowing that further molding and "folding" would be done by hand after the shoe 1002 is taken out of the last 1000 but before the rubber is vulcanized by heat or any powder is added. Folds (or pleas) in the instep, heel and front of the shoe 1002 help maintain a constant pressure on the foot and, at the same time allow to fit the shoe 1002 without the need of shoe laces. They also allow, the same shoe 1002 to fit a wider variety of foot shapes and sizes. The arch of the shoe 1002 was emphasized in this way as well.

In an embodiment, a molded product is provided that includes: an interconnected network of filaments that includes a plurality of filaments entangled within the interconnected network, wherein the interconnected network is coated with an emulsion of polymer molecules in an aqueous medium and dried to form a network of polymer filaments; a mold; and the network of polymer filaments is at least one of affixed to the mold to create the molded product or shaped to the mold to create the molded product.

In an embodiment, the emulsion is latex rubber and the aqueous medium includes at least a portion of water.

In an embodiment, the latex rubber is either pre-vulcanized or includes a vulcanizing agent.

In an embodiment, the network of filaments are coated with the emulsion of polymer molecules by at least one of a dipping, a spraying, a brushing, or a rolling.

In an embodiment, the filaments are selected from the group consisting of sisal, cotton, silk, hemp, flax, alpaca, camel, llama, finn, wool, bamboo, corn husk, linen, yute, ocote, *Sansevieria trifasciata*, carbon, aramid, polymer, optic fiber and combinations thereof.

In an embodiment, the molded product is selected from the group consisting of a shoe, a hat, a plant pot, a lamp shade, a basket, a house, an animal shelter, a boat, a bracelet, a chair, a cell phone cover, a hair band, a jacket, clothing, jewelry, a belt, and an eyeglass frame.

In an embodiment, the system can include at least one additive selected from the group consisting a pigment, a portion of a tree bark, a deodorant, an anti-oxidant, zinc oxide, stearic acid, a fungicide, fire retardant and combinations thereof.

In an embodiment, a method of preparing a molded product of a network of polymer coated filaments is provided that includes at least the steps of: arranging one or more of a plurality filaments to form an interconnected network of filaments, wherein the plurality of filaments are entangled within the interconnected network in a loose configuration which allows air circulation between at least two or more of the filaments; coating the network of filaments with an emulsion of polymer molecules in an aqueous medium to form a coated network; drying the coated network to form a network of polymer coated filaments; and shaping the network of polymer coated filaments to form a molded product.

In an embodiment, the method can include the step of providing a substrate having a first face and a second face, wherein the network of filaments are arranged on either the first face or the second face of the substrate.

In an embodiment, the substrate is selected from a plastic sheet, a plastic mesh, and metal foil.

In an embodiment, the emulsion is latex rubber and the aqueous medium includes a portion of water.

In an embodiment, the latex rubber is pre-vulcanized.

In an embodiment, the latex rubber includes a vulcanizing agent.

In an embodiment, the latex rubber further includes at least one additive selected from the group consisting of a pigment, a portion of tree bark, a deodorant, a fungicide, an anti-oxidant, zinc oxide, stearic acid, fire retardant and combinations thereof.

In an embodiment, the network of polymer coated filaments are coated with a powder selected from the group consisting of corn starch, wheat starch, calcium carbonate, ground wood, ground coal, ash, ground leaves, ground seeds, ground plants, a pigment, a polymer, polyacrylamide and combinations thereof.

In an embodiment, the filaments are selected from the group consisting of natural filaments and synthetic filaments.

In an embodiment, the natural filaments are selected from the group consisting of sisal, cotton, hemp, flax, alpaca, camel, llama, finn, wool, bamboo, fiber, corn husk, linen, yute, ocote, or *Sansevieria trifasciata* natural filaments and combinations thereof.

In an embodiment, the synthetic filaments are selected from the group consisting of carbon, aramid, nylon, polyester, polymer, optic fibers and combinations thereof.

In an embodiment, the molded product is formed manually (e.g., by a user, a hand, a foot, a head, a body part, etc.).

In an embodiment, the method can include the step of vulcanizing or drying the molded product through the application of heat.

The invention as described herein is based upon the understanding that in light of the incremental cross links between polymer molecules in a thermosetting process, there is a gradual shortening of the segments which results in the cross links becoming tighter, thus increasing the overall strength of that area in a non-reversible way. Similarly, it is envisioned that the polymer-polymer bonds between coated filaments imitate both the intra molecular forces and the permanent cross-linking between the molecules in this poly-filament network. This filament medium with which to work, gives rich creative possibilities for different scales and uses by controlling the modeling characteristics of a filament network.

Based upon the foregoing disclosure, it should now be apparent that the molded products made from polymer filament networks 100, as described herein, carry out the objects set forth hereinabove. It is, therefore, to be understood that any variations evident fall within the scope of the claimed invention and thus, the selection of specific elements can be determined without departing from the spirit of the invention herein disclosed and described.

What is claimed is:

1. A molded product comprising:

an interconnected network of filaments that includes a plurality of elongated filaments, each individual elongated filament loosely entangled within the interconnected network to form a mesh, wherein the interconnected network is formed by loosely laying individual uncoated elongated filaments of the plurality of elongated filaments on top of each other at an average density of 350 fibers per square meter such that the individual uncoated elongated filaments cross over one another to create surface area contact between overlapping individual uncoated elongated filaments while leaving spaces between individual uncoated elongated filaments, and coating the plurality of elongated filaments with an emulsion of polymer molecules in an aqueous medium and dried by allowing air circulation through the mesh, between the loosely entangled plurality of elongated filaments, to form a mesh sheet of polymer filaments, wherein the mesh is separated from any other layers of filaments while drying, and wherein the mesh sheet of polymer filaments is at least one of affixed to a mold to create the molded product or shaped to the mold to create the molded product and the molded product includes spaces that allow at least one of air or light to pass through.

2. The molded product of claim 1, wherein the emulsion is latex rubber that is either pre-vulcanized or includes a vulcanizing agent.

3. The molded product of claim 1, wherein the network of filaments are coated with the emulsion of polymer molecules by at least one of a dipping, a spraying, a brushing, or a rolling.

4. The molded product of claim 1, wherein the filaments are selected from the group consisting of sisal filaments, cotton, silk, hemp, flax, alpaca, camel, llama, finn, wool, bamboo, corn husk, linen, yute, ocote, *Sansevieria trifasciata*, carbon, aramid, polymer, optic fiber and combinations thereof.

5. The molded product of claim 1, wherein the molded product is selected from the group consisting of a shoe, a hat, a plant pot, a lamp shade, a basket, a house, an animal shelter, a boat, a bracelet, a chair, a cell phone cover, a hair band, a jacket, a belt, and an eyeglass frame.

6. The molded product of claim 1 further comprising at least one additive selected from the group consisting a pigment, a portion of a tree bark, a deodorant, an anti-oxidant, zinc oxide, stearic acid, fire retardant and combinations thereof.

7. A method of preparing a molded product of a network of polymer coated filaments, the method comprising the steps of:

arranging a plurality of uncoated elongated filaments such that each of the individual uncoated elongated filaments of the plurality of uncoated elongated filaments are substantially entangled by laying the individual uncoated elongated filaments on top of each other in a manner that creates surface area contact between overlapping individual uncoated elongated filaments while leaving spaces between the individual uncoated elongated filaments, to form a mesh sheet of interconnected filaments, wherein the plurality of uncoated filaments within the mesh sheet are arranged in a loose configuration which allows air circulation between at least two or more of the uncoated elongated filaments;

coating the mesh sheet of interconnected filaments with an emulsion of polymer molecules in an aqueous medium to form a coated mesh sheet;

drying the coated mesh sheet by allowing air circulation between the loosely entangled plurality of filaments to form a mesh sheet of polymer coated filaments, wherein the coated mesh sheet is separated from any other layers of filaments while drying; and shaping the mesh sheet of polymer coated filaments to form the molded product, wherein the molded product maintains the spaces between filaments.

8. The method of claim 7 further comprising the step of providing a substrate having a first face and a second face, wherein the network of filaments are arranged on either the first face or the second face of the substrate, and wherein the network of filaments is separated from the substrate as the filaments are fed into the emulsion of polymer molecules.

9. The method of claim 8, wherein the substrate is selected from a plastic sheet, a plastic mesh, and metal foil.

10. The method of claim 7, wherein the emulsion is a latex rubber that includes a vulcanizing agent.

11. The method of claim 10, wherein the latex rubber further includes at least one additive selected from the group consisting of a pigment, a portion of tree bark, a deodorant, an anti-oxidant, zinc oxide, stearic acid, fire retardant and combinations thereof.

12. The method of claim 7, wherein the network of polymer coated filaments are coated with a powder selected from the group consisting of corn starch, wheat starch, calcium carbonate, ground wood, ground coal, ash, ground leaves, ground seeds, ground plants, a pigment, a polymer, polyacrylamide and combinations thereof.

13. The method of claim 7, wherein the filaments are selected from the group consisting of natural filaments and synthetic filaments.

14. The method of claim 13, wherein the natural filaments are selected from the group consisting of sisal, cotton, hemp, flax, alpaca, camel, llama, finn, wool, bamboo, fiber, corn husk, linen, yute, ocote, or *Sansevieria trifasciata* natural filaments and combinations thereof.

15. The method of claim 7 further comprising the step of vulcanizing or drying the molded product through the application of heat.

16. A method of preparing a molded product of a network of polymer coated filaments, the method comprising the steps of:

arranging a plurality of uncoated elongated natural filaments in a loose configuration by loosely entangling each of the individual uncoated elongated natural filaments of the plurality of uncoated elongated natural filaments in a manner that creates surface area contact between overlapping individual uncoated elongated natural filaments while leaving spaces between individual uncoated elongated natural filaments to form an interconnected network of elongated natural filaments arranged as a mesh, wherein the loose configuration allows air circulation between at least two or more of the plurality of uncoated elongated natural filaments;

providing a latex rubber;

coating the interconnected network of elongated natural filaments with an emulsion of the latex rubber in an aqueous medium to form a coated network;

drying the coated network by allowing air circulation between the loosely entangled interconnected network of elongated natural filaments to form a network of latex rubber coated elongated natural filaments, wherein the coated network is separated from any other layers of filaments while drying; and shaping the network of latex rubber coated elongated natural filaments to form the molded product, wherein the molded product maintains the spaces between filaments.

17. The molded product of claim 1, wherein the elongated filaments have an average length of 90 cm.

18. The method of claim 7, wherein the elongated natural filaments are arranged at an average density of 350 fibers per square meter.

19. The method of claim 7, wherein the elongated natural filaments have an average length of 90 cm.

20. The method of claim 16 wherein the elongated natural filaments are at an average density of 350 fibers per square meter.

* * * * *